United States Patent [19]

Kobayashi et al.

[11] Patent Number: 5,007,183

[45] Date of Patent: Apr. 16, 1991

[54] VACUUM DRIER APPARATUS

[75] Inventors: Nobutoshi Kobayashi; Tetsuo Murakami, both of Tokyo, Japan

[73] Assignees: Nippon Scientific Co., Ltd.; Kusumoto Chemicals Co., Ltd., both of Tokyo, Japan

[21] Appl. No.: 583,999

[22] Filed: Sep. 18, 1990

[30] Foreign Application Priority Data

Sep. 20, 1989 [JP] Japan ..... 1-242137

[51] Int. Cl.[5] ..... E26B 13/30; E06B 7/28; E06B 9/00

[52] U.S. Cl. ..... 34/92; 34/15; 109/49.5; 49/171

[58] Field of Search ..... 34/92, 5, 15; 109/11, 109/21.5, 49.5, 58.5; 49/171

[56] References Cited

U.S. PATENT DOCUMENTS

| | | | |
|---|---|---|---|
| 4,061,093 | 12/1977 | Carstens et al. | 109/21.5 X |
| 4,245,566 | 1/1981 | Shimansky et al. | 49/171 X |
| 4,319,408 | 3/1982 | Kuboyama | 34/92 X |
| 4,727,789 | 3/1988 | Katsanis et al. | 109/49.5 X |

FOREIGN PATENT DOCUMENTS

| | | | |
|---|---|---|---|
| 3054200 | 3/1988 | Japan | 34/92 |
| 0821881 | 4/1981 | U.S.S.R. | 34/92 |

*Primary Examiner*—Henry A. Bennett
*Assistant Examiner*—Christopher B. Kilner
*Attorney, Agent, or Firm*—Hedman, Gibson, Costigan & Hoare

[57] ABSTRACT

A vacuum drier apparatus capable of preventing the thermal deformation of the protection member as well as scattering of the tempered glass plate in a case of an accidental breaking of the tempered glass plate. The apparatus includes elastic supporter members located between the glass plate and the protection member, for supporting the glass plate and the protection member with respect to each other, such that the glass plate can be pressed tightly to seal off the opening section of the vacuum drying space, while the protection member can be pushed away from an edge of the front side of the opening window by an external pressure exerting on the protection member. The protection member is preferably a transparent plastic plate in an outwardly curving dome-shaped form.

5 Claims, 2 Drawing Sheets

VACUUM DRIER APPARATUS

BACKGROUND OF THE INVENTION

1. Field of the Invention

The present invention relates to a vacuum drier apparatus for drying materials such as heat sensitive chemical materials and powders, for example.

2. Description of the Background Art

A vacuum drier apparatus has been used for drying materials such as heat sensitive chemical materials and powders, for example.

Such a conventional vacuum drier apparatus is usually equipped with an openable door having an observation window made from a piece of tempered glass plate. This tempered glass plate is designed to have such a thickness that it can endure the atmospheric pressure, and may be shaped in a protruding form.

However, it is necessary to provide a protection against an accidental breaking of this tempered glass plate due to an exertion of external forces. Such a protection is usually provided in a form of a protection plate such as that made of metallic mesh or transparent plastic plate which is placed in front of the tempered glass plate. This protection plate also serves, in a case of an accidental breaking of the tempered glass plate, to prevent the scattering of the broken glass pieces which are sucked into a vacuum drying chamber because of the reduction of pressure inside the vacuum drying chamber, and then bounce off a backside wall of the vacuum drying chamber.

For such a protection plate, the plastic plate is more commonly employed than a metallic mesh because it becomes easier to observe the inside of the vacuum drying chamber.

However, the protection plate made of a plastic plate also has a problem that it is subject to a thermal deformation due to the heat inside the vacuum drying chamber.

Also, conventionally, the protection plate made of a plastic plate has a problem in its strength, such that it sometimes does not function sufficiently as the protection plate because of its inadequate strength.

In a case when the protection plate made of a plastic plate and is attached with a slight clearance for entering the air from outside in order to prevent the reduction of pressure inside, there is a problem of contamination of the interior due to the external objects entering along with the air.

SUMMARY OF THE INVENTION

It is therefore an object of the present invention to provide a vacuum drier apparatus capable of preventing the thermal deformation of the protection member as well as scattering of the tempered glass plate in a case of an accidental breaking of the tempered glass plate.

This object is achieved in the present invention by providing a vacuum drier apparatus, comprising: a vacuum drying chamber having a vacuum drying space for performing a vacuum drying on an object to be dried therein, the vacuum drying space having an opening section; and an openable door having an opening window, which is provided in front of the vacuum drying chamber to close off the opening section of the vacuum drying space, the door including: a transparent glass plate provided on a rear side of the opening window facing toward the opening section of the vacuum drying space, which seals off the opening section when the door is closed; a transparent protection member provided on a front side of the opening window facing away from the opening section of the vacuum drying space, in front of the glass plate; and elastic supporter means located between the glass plate and the protection member, for supporting the glass plate and the protection member with respect to each other, such that the glass plate can be pressed tightly to seal off the opening section of the vacuum drying space, while the protection member can be pushed away from an edge of the front side of the opening window by an external pressure exerting on the protection member.

Other features and advantages of the present invention will become apparent from the following description taken in conjunction with the accompanying drawings.

DETAILED DESCRIPTION OF THE PREFERRED EMBODIMENTS

Figure 1:
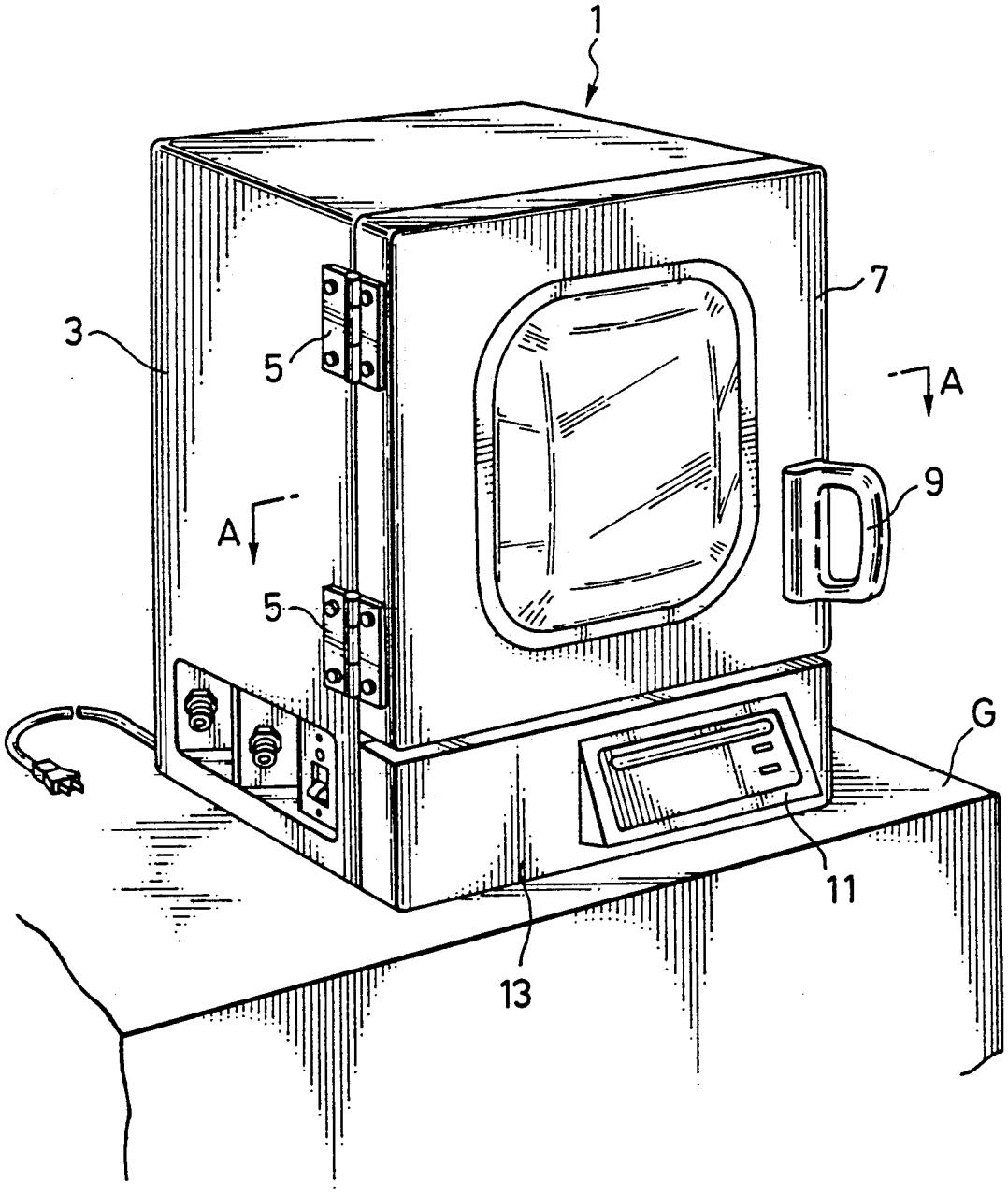
FIG. 1 is a perspective view of one embodiment of a vacuum drier apparatus according to the present invention.

Referring now to FIG. 1, there is shown one embodiment of a vacuum drier apparatus according to the present invention.

In this embodiment, the vacuum drier apparatus 1 mounted on a table G generally comprises a vacuum drying chamber 3, and an openable door 7 attached on a front side of the vacuum drying chamber 3 by means of hinges 5, which is equipped with a handle 9. Also, on the front side of the vacuum drying chamber 3, below the door 7, there is provided a front plate 13 equipped with a control panel 11 at which the vacuum drier apparatus 1 can be operated.

In this vacuum drier apparatus 1, an operator opens the door 7 by pulling the handle 9 away from the vacuum drying chamber 3, so that the door 7 opens with the hinges 5 as pivotal points, then the operator places an object to be dried inside the vacuum drying chamber 3, closes the door 7, and controls the control panel 11, so that the object to be dried can be dried up.

Figure 2:
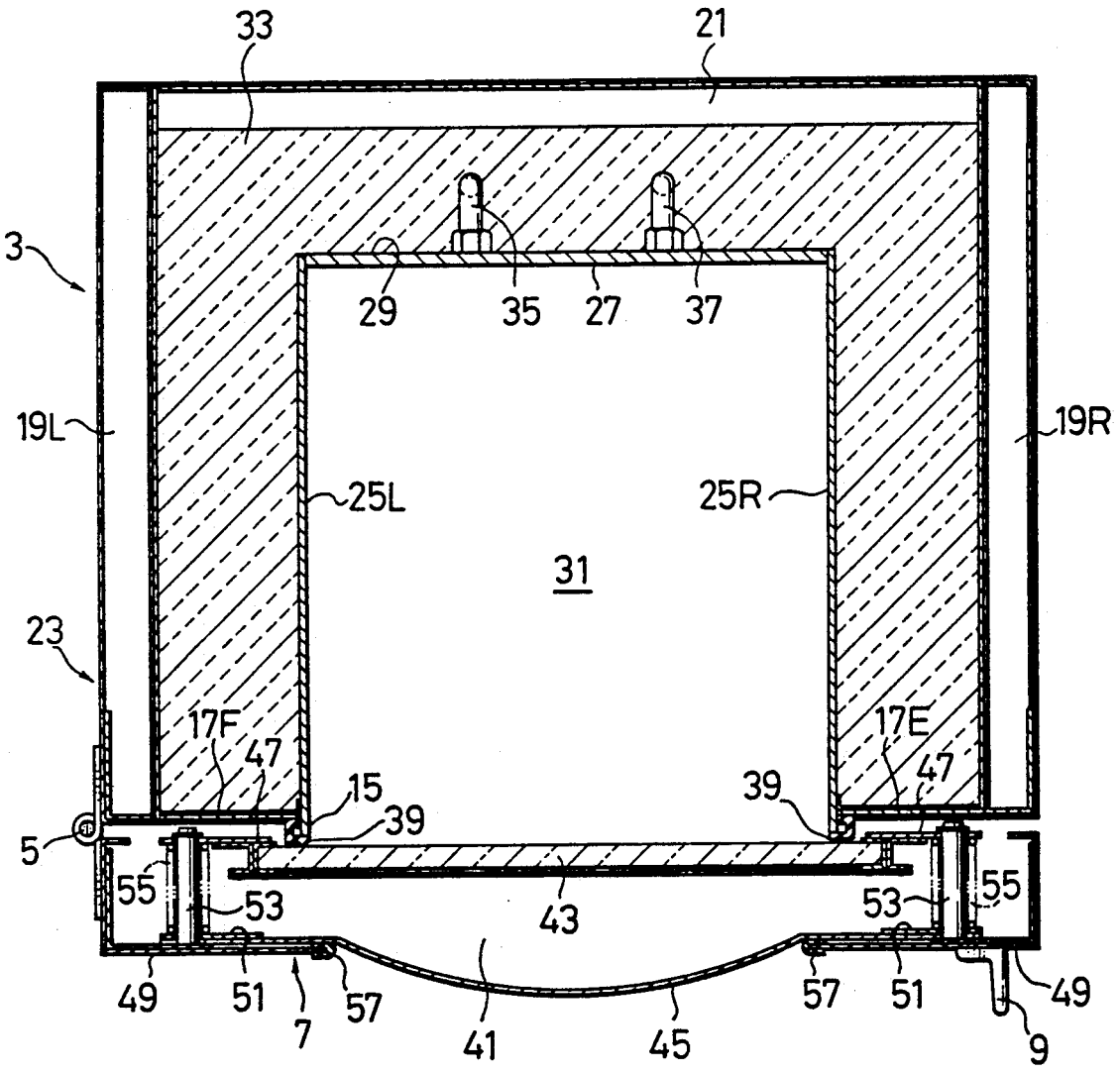
FIG. 2 is a cross sectional view of a vacuum drying chamber of the vacuum drier apparatus of FIG. 1.

In further detail, as shown in FIG. 2, the vacuum drying chamber 3 comprises: an outer frame 23 formed by a front outer frame 17F having an opening section 15, side outer frames 19R and 19L, and a rear outer frame 21; and an inner frame 29 formed by a side inner frames 25R and 25L, and a rear inner frame 27, defining a vacuum drying space 31 therein.

On the outer circumference of the inner frame 29, there is provided a heater (not shown) for maintaining a temperature inside the vacuum drying space 31. Also, a space between the inner frame 29 and the outer frame 23 is filled with an thermal insulator materials 33.

On a back of the rear inner frame 27, there are provided a first pipe 35 through which an inert gas such as $N_2$ gas is poured into the vacuum drying space 31, and a second pipe 37 through which an air inside the vacuum drying space 31 is pumped out to obtain a vacuum state. The first pipe 35 is connected to a gas supply device (not shown) located outside of the vacuum drying chamber 3, while the second pipe 37 is connected to a vacuum pump (not shown) also located outside of the vacuum drying chamber 3.

On a front side of the front outer frame 17F, there is provided a rubber packing 39.

Also, as shown in FIG. 2, a front side of the door 7 has an opening window 41 corresponding to the opening section 15 of the vacuum drying chamber 3. A rear side of this opening window 41 facing toward the vacuum drying space 31 is equipped with a transparent tempered glass plate 43 which makes contact with the rubber packing 39 when the door 7 is closed, while a front side of the opening window 41 facing toward outside is equipped with a protection member 45 made of a outwardly curving dome-shaped transparent plastic plate.

The glass plate 43 is supported by a supporting members 47 from two sides, while the protection member 45 is supported with respect to the frame 49 of the door 7 by having its end portions pinched between supporting members 51 and the frame 49. Also, near the four corners of the frame 49, there are provided supporting rods 53 around which springs 55 are wound, and to which the supporting members 47 and the supporting members 51 are attached with the springs 55 placed therebetween. Also, a front edge of the opening window 41 at which the protection member 45 is provided is equipped with a rubber packing 57.

In this configuration, when the object to be dried is placed inside the vacuum drying space 31, the heater is turned on, while the vacuum pump is activated to pump out the air from the vacuum drying space 31, so as to have the vacuum drying performed for the object to be dried. When the air is pumped out from the vacuum drying space 31, the glass plate 43 is pressed against the packing 39 by means of the springs 55, so as to maintain the vacuum state by sealing off the vacuum drying space 31. Here, the pressing of the glass plate 43 against the packing 39 can provide a sufficient sealing of the vacuum drying space 31, so that slight irregularity in manufacturing accuracy of the other elements such as the front outer frame 17F or supporting members 47 can be tolerated.

When the vacuum drying space 31 is maintained at a heated temperature for a long period of time, the glass plate 43 is also heated up by this temperature of the vacuum drying space 31, and then the protection member 45 also is heated by thermal transfer from the glass plate 43 and experiences the thermal expansion. However, because the protection member 45 is dome-shaped, the difference in amounts of thermal expansion caused by the temperature difference between inside and outside is absorbed, so that the thermal deformation on a surface of the protection member 45 is prevented.

In a case the glass plate 43 is broken by some cause, the pieces of the broken glass plate 43 hit on the rear inner frame 27, and bounces off forward to scatter. At this point, the space between the glass plate 43 and the protection member 45 tends to be in a state of a reduced pressure. As a result, the atmospheric pressure which is now stronger than a force due to the springs 55 is exerted on the protection member 45 to push the protection member 45 toward the vacuum drying space 31 such that a space is formed between the protection member 45 and the frame 49 of the door 7 through which the air flows into the space between the glass plate 43 and the protection member 45 until the pressure there is restored up to the level of the atmospheric pressure. Thus, the scattering of the broken glass plate pieces can be prevented without producing an exertion of an external pressure on the protection member 45.

Thus, according to this embodiment, it is possible to provide a vacuum drier apparatus capable of preventing the thermal deformation of the protection member as well as scattering of the tempered glass plate in a case of an accidental breaking of the tempered glass plate.

It is to be noted that, many modifications and variations of the above embodiment may be made without departing from the novel and advantageous features of the present invention. Accordingly, all such modifications and variations are intended to be included within the scope of the appended claims.

What is claimed is:

1. A vacuum drier apparatus, comprising:

a vacuum drying chamber having a vacuum drying space for performing a vacuum drying on an object to be dried therein, the vacuum drying space having an opening section; and an openable door having an opening window, which is provided in front of the vacuum drying chamber to close off the opening section of the vacuum drying space, the door including:

a transparent glass plate provided on a rear side of the opening window facing toward the opening section of the vacuum drying space, which seals off the opening section when the door is closed;

a transparent protection member provided on a front side of the opening window facing away from the opening section of the vacuum drying space, in front of the glass plate; and elastic supporter means located between the glass plate and the protection member, for supporting the glass plate and the protection member with respect to each other, such that the glass plate can be pressed tightly to seal off the opening section of the vacuum drying space, while the protection member can be pushed away from an edge of the front side of the opening window by an external pressure exerting on the protection member.

2. The apparatus of claim 1, wherein the protection member has an outwardly curving dome-shaped form.

3. The apparatus of claim 1, wherein the protection member is made of a plastic plate.

4. The apparatus of claim 1, wherein the edge of the front side of the opening window has a rubber packing means for making a sealing contact with the protection member.

5. The apparatus of claim 1, wherein the elastic supporter means comprises rods with springs wound around.

* * * * *